US009805646B2

(12) United States Patent
Park

(10) Patent No.: US 9,805,646 B2
(45) Date of Patent: Oct. 31, 2017

(54) DISPLAY DEVICE AND METHOD FOR COMPENSATING DEGRADATION OF DISPLAY DEVICE

(71) Applicant: SAMSUNG DISPLAY CO., LTD., Yongin-si, Gyeonggi-Do (KR)

(72) Inventor: Ji-Eun Park, Suwon-si (KR)

(73) Assignee: Samsung Display Co., Ltd., Yongin-si, Gyeonggi-do (KR)

( * ) Notice: Subject to any disclaimer, the term of this patent is extended or adjusted under 35 U.S.C. 154(b) by 241 days.

(21) Appl. No.: 14/841,822

(22) Filed: Sep. 1, 2015

(65) Prior Publication Data

US 2016/0148561 A1 May 26, 2016

(30) Foreign Application Priority Data

Nov. 26, 2014 (KR) ..... 10-2014-0166121

(51) Int. Cl.
*G09G 5/10* (2006.01)
*G09G 3/3225* (2016.01)

(52) U.S. Cl.
CPC ..... *G09G 3/3225* (2013.01); *G09G 2300/043* (2013.01); *G09G 2320/0285* (2013.01); *G09G 2320/0295* (2013.01); *G09G 2320/045* (2013.01); *G09G 2360/16* (2013.01)

(58) Field of Classification Search
CPC ..... G09G 3/3225
USPC ..... 345/690
See application file for complete search history.

(56) References Cited

U.S. PATENT DOCUMENTS

2015/0123953 A1* 5/2015 Shim ..... G09G 3/3233 345/205
2015/0154913 A1* 6/2015 Kim ..... G09G 3/3233 345/691
2015/0379940 A1* 12/2015 Kishi ..... G09G 3/3225 345/690
2016/0012798 A1* 1/2016 Oh ..... G09G 3/325 345/205
2016/0071445 A1* 3/2016 Kim ..... G09G 3/006 345/212
2017/0148385 A1* 5/2017 Kishi ..... G09G 3/3233

FOREIGN PATENT DOCUMENTS

KR 10-2006-0099315 A 9/2006
KR 10-2008-0066421 A 7/2008
KR 10-2010-0011954 A 2/2010
KR 10-2012-0112051 A 10/2012

* cited by examiner

*Primary Examiner* — Jason Olson
(74) *Attorney, Agent, or Firm* — Lee & Morse, P.C.

(57) ABSTRACT

A display device includes a display panel, a plurality of readout circuits, and a deviation corrector. The display panel includes a plurality of pixels. The readout integrated circuits perform a readout operation of detected values including degradation information of the pixels, via readout lines connected to the pixels, when a degradation detecting operation is performed. The deviation corrector calculates weighted values to correct operating deviation of the readout integrated circuits based on an average of initial values. The deviation corrector generates corrected image data to correct input image data based on the weighted values. The initial values correspond to the detected values output from the readout integrated circuits when the display panel is in an initial state in which the pixels are non-degraded.

20 Claims, 6 Drawing Sheets

DISPLAY DEVICE AND METHOD FOR COMPENSATING DEGRADATION OF DISPLAY DEVICE

CROSS REFERENCE TO RELATED APPLICATION

Korean Patent Application No. 10-2014-0166121, filed on Nov. 26, 2014, and entitled: "Display Device and Method For Compensating Degradation Of Display Device," is incorporated by reference herein in its entirety.

BACKGROUND

1. Field

One or more embodiments herein relate to a display device, and method for compensating degradation of a display device.

2. Description of Related Art

An organic light-emitting diode (OLED) display has favorable characteristics such as rapid response speed and low power consumption. This is because OLEDs are self-emitting devices that generate light based on a recombination of electrons and holes.

During operation, the pixels of the display may degrade over time based on changes in characteristics of the organic material in the OLEDs. The display device may attempt to compensate for this degradation in various ways. One way involves using readout integrated circuits to measure (or detect) degrees of degradation of the pixels. In this case, detected values output from the readout integrated circuits may be different, even when the pixels have the same degree of degradation. This is because the readout integrated circuits have operating deviations different from each other. As a result, the accuracy of detecting pixel degradation may be unreliable.

In an attempt to correct the operating deviation among the readout integrated circuits, the readout integrated circuits may be calibrated. However, this approach increases manufacturing costs and complicates the overall manufacturing process.

SUMMARY

In accordance with one or more embodiments, a display device includes a display panel including a plurality of pixels; a plurality of readout integrated circuits to perform a readout operation of detected values including degradation information of the pixels, via a plurality of readout lines connected to the pixels, when a degradation detecting operation is performed; a deviation corrector to calculate weighted values to correct operating deviation of the readout integrated circuits based on an average of initial values, and to generate corrected image data to correct input image data based on the weighted values, the initial values being the detected values output from the readout integrated circuits when the display panel is in an initial state in which the pixels are non-degraded; a scan driver to provide a scan signal to the display panel via a plurality of scan lines; a data driver to provide a data signals corresponding to the corrected image data to the display panel via a plurality of data lines; and a timing controller to control the readout integrated circuits, the scan driver, and the data driver.

The display panel may include first through (M)-th pixel columns, where M is a positive integer greater than 1, and the first through (M)-th pixel columns may be connected to first through (M)-th readout lines, respectively.

The deviation corrector may include a first average calculator to calculate first through (M)-th readout line averages based on the initial values, the first through (M)-th readout line averages being averages of the initial values readout from each of the first through (M)-th readout lines; a second average calculator to calculate an initial value average, that is an average of the initial values, based on the first through (M)th readout line averages; and a weighted value calculator to calculate first through (M)th weighted values with respect to the first through (M)-th readout lines, the first through (M)th weighted values to be calculated dividing each of the first through (M)th readout line averages by the initial value average.

The deviation corrector may include a degradation compensator to generate corrected values of the detected values to compensate degradation of the pixels, by respectively applying the first through (M)-th weighted values to the detected values of the pixels that correspond to the first through (M)-th readout lines, and to generate the corrected image data based on the corrected values.

The deviation corrector may include an initial value estimator to calculate an estimated initial value of a degraded pixel based on the initial values of non-degraded pixels adjacent to the degraded pixel when the degraded pixel is detected. The non-degraded pixels for calculating the estimated initial value and the degraded pixel may be in a same pixel column.

The first calculator may calculate a (K)-th readout line average based on the initial values corresponding to a (K)-th pixel column and the estimated initial value corresponding to the (K)-th pixel column when the degraded pixel is in the (K)th pixel column, where K is a positive integer less than or equal to M. The non-degraded pixels for calculating the estimated initial value and the degraded pixel may be in a same pixel row. The initial values may correspond to drive currents of the pixels in the initial state. The initial values may correspond to drive voltages of the pixels in the initial state. A number of the readout lines may be equal to a number of the data lines. The deviation corrector may be in the timing controller.

In accordance with one or more other embodiments, a method for compensating degradation of a display device includes calculating weighted values to correct operating deviation of a plurality of readout integrated circuits, the weighted values to be calculated based on an average of initial values output from the readout integrated circuits when a display panel is in an initial state in which the pixels are non-degraded; detecting detected values including degradation information of the pixels by the readout integrated circuits; calculating corrected values of the detected values to compensate degradation of the pixels by applying the weighted values to the detected values of the pixels; and generating corrected image data to correct input image data based on the corrected values.

The display panel may include first through (M)-th pixel columns, where M is a positive integer greater than 1, and the first through (M)-th pixel columns may be connected to first through (M)th readout lines, respectively.

Calculating the weighted values may include performing a readout operation of the initial values output from the first through (M)-th readout lines; calculating first through (M)th readout line averages that correspond to respective averages of the initial values corresponding to the first through (M)-th readout lines; calculating an initial value average corresponding to an average of the initial values, the initial value average calculated based on the first through (M)-th readout line averages; and calculating first through (M)-th weighted values corresponding to the first through (M)-th readout lines, the first through (M)-th weighted values calculated by dividing the first through (M)-th readout line averages by the initial value average.

Calculating the weighted values may include calculating an estimated initial value of a degraded pixel when the degraded pixel is detected; and calculating first through (M)-th weighted values corresponding to the first through (M)-th readout lines based on the initial values and the estimated initial value. The estimated initial value may be estimated based on the initial values of non-degraded pixels adjacent to the degraded pixel.

The initial values may correspond to drive currents of the pixels in the initial state. The initial values may correspond to drive voltages of the pixels in the initial state. A number of the readout lines may be equal to a number of the data lines.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
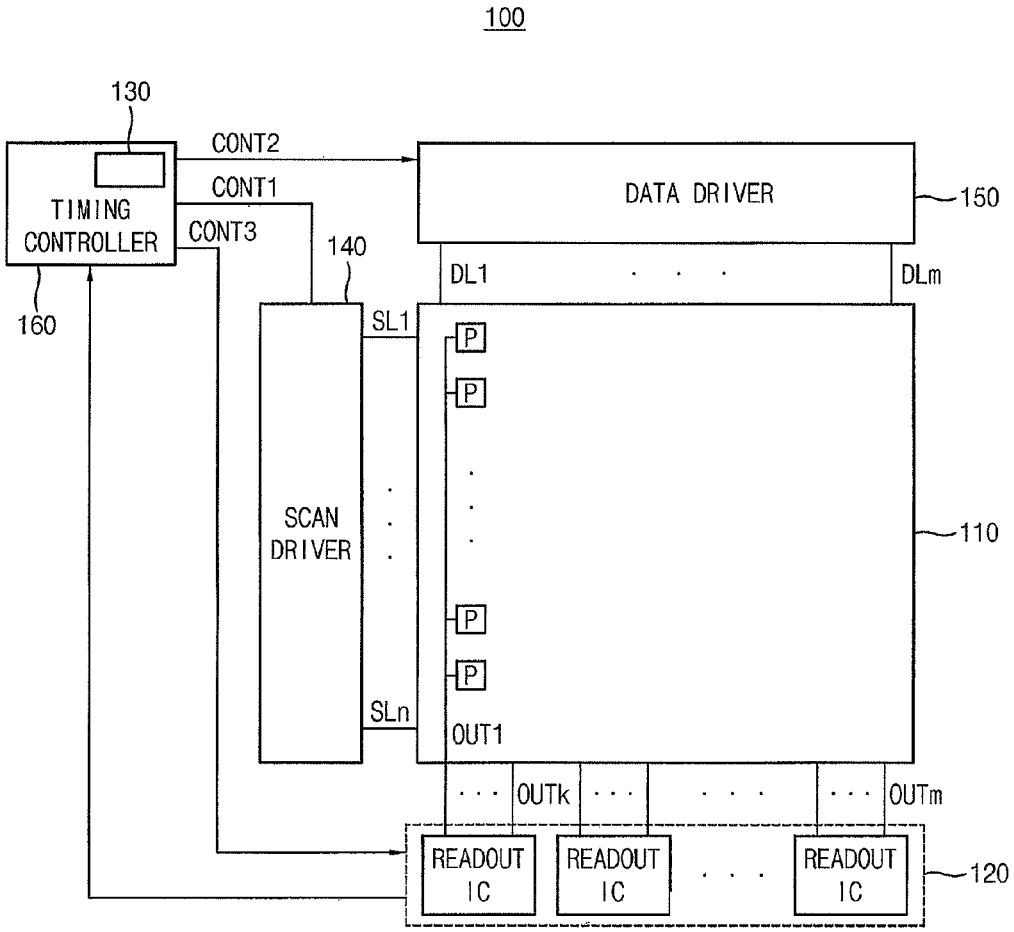
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

FIG. 1 illustrates an embodiment of a display device 100 which includes a display panel 110, a plurality of readout integrated circuits 120, a deviation corrector 130, a scan driver 140, a data driver 150 and a timing controller 160. In one embodiment, the timing controller 160 may include the corrector 130.

The display panel 110 includes a plurality of pixels P. The display panel 110 may include, for example, first through (M)-th pixel columns, where each of the columns include one or more pixels P. The value of M is a positive integer equal to or greater than 1. The display panel 110 also includes a plurality of scan lines SL1 through SLn, a plurality of data lines DL1 through DLm, and a plurality of readout lines OUT1 through OUTm that cross the scan lines SL1 through SLn.

The scan lines SL1 through SLn may be arranged in a pixel row direction, and the data lines DL1 through DLm and the readout lines OUT1 through OUTm may be arranged in a pixel column direction. These lines may be arranged in one or more different directions in another embodiment. The pixels P may be arranged in a matrix. The number of scan lines SL1 through SLn may be N, where N is a positive integer. The number of the data lines DL1 through DLm may be M, where M is a positive integer. Thus, the display panel 110 may include N*M pixels, where each pixel P includes a switching transistor and an organic light emitting diode (OLED).

Each readout integrated circuit 120 includes a plurality of readout lines. The readout integrated circuits 120 perform a readout operation of detected values having degradation information of the pixels via readout lines connected to the pixels P. For example, the readout integrated circuits 120 may perform the readout operation of detection signals output from the pixels P via the readout lines OUT1 through OUTm when a degradation detecting operation is performed. The readout integrated circuits 120 may judge whether the pixels P are degraded based on the detection signals.

In one embodiment, the readout integrated circuits 120 may convert the detection signal (or the detected value) to a digital signal using an analog-to-digital converting (ADC) circuit. The number of the readout lines OUT1 through OUTm may be, for example, equal to the number of the data lines DL1 through DLm. For example, the readout lines OUT1 through OUTm may be arranged in the display panel 110 respectively corresponding to pixel columns. In one example embodiment, first through (M)th pixel columns may be connected to first through (M)th readout lines OUT1 through OUTm, respectively. For example, the pixels corresponding to a (K)-th pixel column may be connected to a (K)-th readout line OUTk, where K is a positive integer less than or equal to M.

The display device 100 includes the readout integrated circuits 120 to detect degrees of degradation of the pixels P. Values including degradation information indicative of the degrees of degradation of the pixels P are output from the pixels P when a degradation detecting operation is performed. The readout integrated circuits 120 perform the readout operation of detected values so that a data signal applied to the display panel 110 may be compensated.

The readout integrated circuits 120 may readout the detected values periodically or within a predetermined period, for example, by controlling the timing controller 160. The outputs (or detected values) from the readout integrated circuits 120 with substantially the same degree of degradation may be different due to an operating deviation of the readout integrated circuits 120, when different readout integrated circuits receive the same detected value. Thus, the operating deviation of the readout integrated circuits 120 may be corrected.

In one example embodiment, the readout integrated circuits 120 may output initial values that are the detected values of non-degraded pixels P when the display panel 110 is in an initial state, in which the pixels P are non-degraded. The initial values may be applied to the deviation corrector 130 to correct operating deviation of the readout integrated circuits 120. The readout integrated circuits 120 may provide the detected values and the initial values to the deviation corrector 130.

The deviation corrector 130 may calculate weighted values to correct the operating deviation of the readout integrated circuits 120. The deviation corrector 130 may calculate weighted values based on an average of the initial values. The initial values may be output from the readout integrated circuits 120 when the display panel 110 is in an initial state in which all of the pixels P are non-degraded. For example, the initial values are the detected values in the initial state. In one example embodiment, the initial values may correspond to drive currents of the pixels P in the initial state. In another example embodiment, the initial values may correspond to drive voltages of the pixels P in the initial state. The deviation corrector 130 may be in the timing controller 160 or be connected to the timing controller 160.

The deviation corrector 130 generates the weighted values based on deviation of the drive currents or deviation of the drive voltages in the initial state, and generates a data signal applying the weighted values. Thus, the operating deviation of the readout integrated circuits 120 may be corrected. In one embodiment, the deviation corrector 130 includes a number of calculators. A first average calculator calculates first through (M)-th readout line averages that correspond to averages of the initial values corresponding to the first through (M)-th readout lines OUT1 through OUTm. A second average calculator calculates an initial value average based on the first through (M)-th readout line averages. A weighted value calculator calculates first through (M)-th weighted values, with respect to the first through (M)-th readout lines, by dividing each of the first through (M)-th readout line averages by the initial value average. The initial value average may, for example, be an average of the whole initial values.

An operation for calculating the weighted values using the deviation corrector 130 may be implemented, for example, based on a software algorithm (e.g., averaging algorithm, multiplying algorithm, etc). The compensating pixel degradation program having the algorithm may be executed regardless of time and place. The program may be automatically executed based on one or more predetermined conditions or may be executed in response to a user signal.

In one embodiment, the deviation corrector 130 generates corrected values of the detected values to compensate degradation of the pixels P, by respectively applying the first through (M)-th weighted values to the detected values of the pixels P that correspond to the first through (M)-th readout lines OUT1 through OUTm. The deviation corrector 130 generates the corrected image data based on the corrected values.

The pixels P may degrade over time due to variations in the characteristics of organic materials used for the OLEDs. The readout integrated circuits 120 may detect whether the pixels P are degraded and/or the degree of degradation of the pixels P. The deviation corrector 130 may calculate an estimated initial value of a degraded pixel based on the initial values of non-degraded pixels adjacent to a degraded pixel, when a degraded pixel is detected. For example, the estimated initial value may be estimated by interpolating at least two initial values. The deviation corrector 130 generates the first through (M)-th weighted values based on averages of the initial values and the estimated initial values. The deviation corrector 130 generates the corrected values of the detected values based on the first through (M)-th weighted values, and generates the corrected image data to correct input image data based on the corrected values.

The scan driver 140 provides a scan signal to the display panel 110 via the scan lines SL1 through SLn. The data driver 150 provides data signals corresponding to the corrected image data to the display panel 110 via the data lines DL1 through DLm. In one embodiment, the corrected image data may be generated in the timing controller 160 including the deviation corrector 130.

The timing controller 160 controls the readout integrated circuits 120, the scan driver 140, and the data driver 150 based on first through third control signals CONT1, CONT2, and CONT3. In one embodiment, the timing controller 160 receives an input control signal and the input image data from an image source, e.g., an external graphic apparatus. The input control signal may include a main clock signal, a vertical synchronizing signal, a horizontal synchronizing signal, and a data enable signal. The timing controller 160 may generate digital image data and signals corresponding to operating conditions of the display panel 110 based on the input image data. In one embodiment, the timing controller 160 includes the deviation corrector 130 and generates the corrected image data based on the detected values from the readout integrated circuits 120 and the weighted values from the deviation corrector 130.

As previously indicated, the display device 100, including the plurality of readout integrated circuits 120, may include the deviation corrector 130 for generating the first through (M)-th weighted values based on the initial values, so that the detected values having degradation information of the pixels may be efficiently corrected based on the first through (M)-th weighted values. Thus, the operating deviation of the readout integrated circuits 120 may be improved and the accuracy of the detected values may be improved. As a result, defects of the display panel resulting from degraded pixels may be reduced or prevented.

Operation of the deviation corrector 130 may be implemented by hardware, software, or both. When operated purely by software, additional hardware circuits are not required, thereby resulting in a reduction in manufacturing time and cost.

Figure 2:
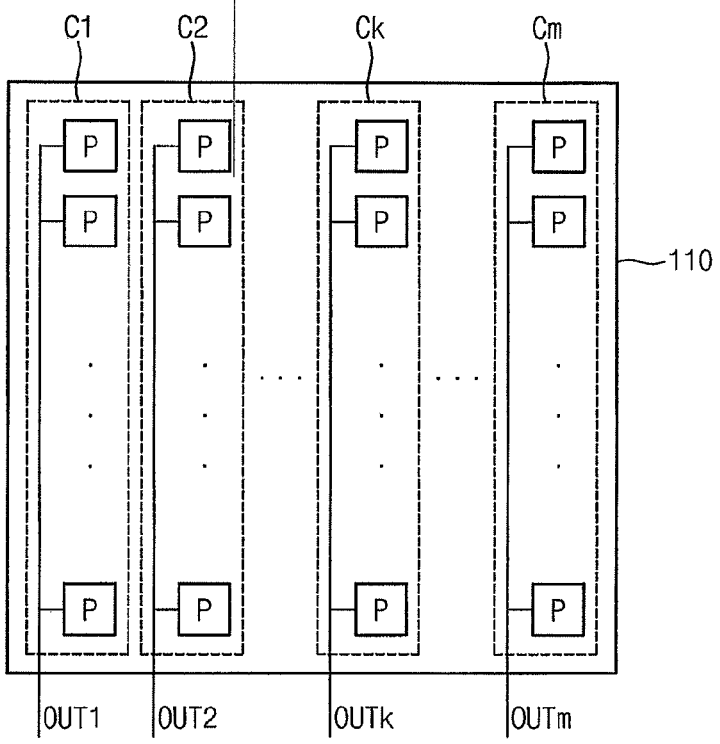
FIG. 2 illustrates an embodiment of readout lines connected to pixels.

FIG. 2 illustrates an embodiment of readout lines connected to pixels in the display device of FIG. 1. Referring to FIGS. 1 and 2, the display panel 110 includes a plurality of readout lines OUT1 through OUTm arranged in the pixel column direction.

The display panel 110 may include first through (M)-th pixel columns C1 through Cm, each column having one or more pixels P. The first through (M)th pixel columns C1 through Cm are connected to the first through (M)-th readout lines OUT1 through OUTm. For example, a (K)-th pixel column Ck may be connected to a (K)-th readout line OUTk, where K is a positive integer less than or equal to M. The pixels P in the (K)-th pixel column Ck may be connected to the (K)-th readout line OUTk. The initial values and the detected values output from the pixels in the (K)-th pixel column Ck may be applied to one of the readout integrated circuits 120 via the (K)-th readout line OUTk.

Each readout integrated circuit 120 provides the detected values and the initial values to the deviation corrector 130. The deviation corrector 130 calculates a (K)-th readout line average based on the initial values of the pixels connected to the (K)-th readout line OUTk. The deviation corrector 130 generates the first through (M)-th weighted value for correcting the detected values. For example, the same weighted value may be applied to data signals provided to the pixels in the same pixel column.

Figure 3:
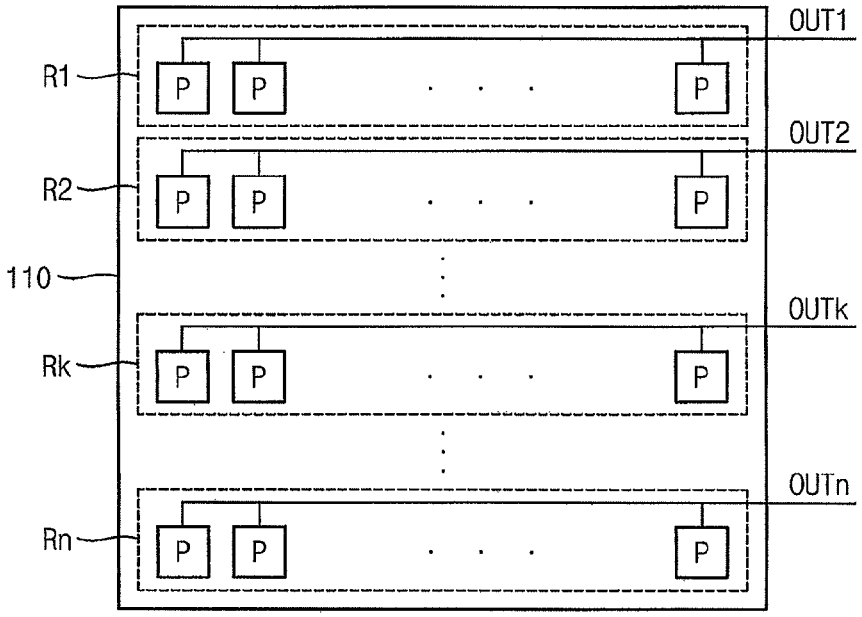
FIG. 3 illustrates another embodiment of readout lines connected to pixels.

FIG. 3 illustrates another embodiment of readout lines connected to pixels in the display device of FIG. 1. Referring to FIG. 3, the display panel 110 includes readout lines OUT1 through OUTn arranged in the pixel row direction.

The display panel 110 includes first through (N)-th pixel rows R1 through Rn each having one or more pixels P. The first through (N)-th pixel rows R1 through Rn are connected to the first through (N)-th readout lines OUT1 through OUTn. For example, a (K)-th pixel row Rk may be connected to a (K)-th readout line OUTk, where K is a positive integer less than or equal to N. The pixels P in the (K)-th pixel row Rk are connected to the (K)-th readout line OUTk. The initial values and the detected values output from the pixels in the (K)-th pixel row Rk are applied to one of the readout integrated circuits via the (K)-th readout line OUTk.

Each readout integrated circuit provides the detected values and the initial values to the deviation corrector 130. The deviation corrector 130 calculates a (K)-th readout line average based on the initial values of the pixels connected to the (K)-th readout line OUTk. The deviation corrector 130 may generates first through (N)-th weighted value(s) for correcting the detected values. In one embodiment, the same weighted value may be applied to data signals provided to the pixels in the same pixel row.

Figure 4:
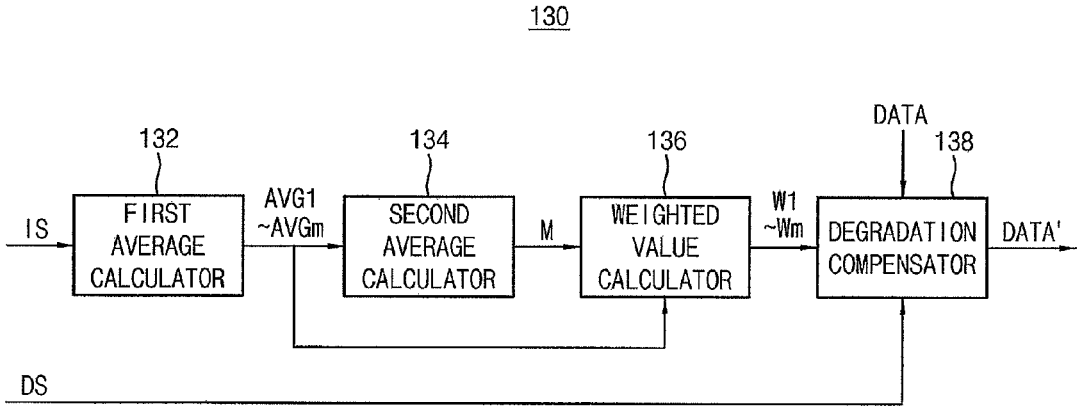
FIG. 4 illustrates an embodiment of a deviation corrector.

FIG. 4 illustrates an embodiment of a deviation corrector 130 in the display device of FIG. 1. Referring to FIGS. 1, 2, and 4, the deviation corrector 130 includes a first average calculator 132, a second average calculator 134, and a weighted value calculator 136. The deviation corrector may further include a degradation compensator 138 to correct image data based on the detected values DS having degradation information.

The deviation corrector 130 generates the weighted values W1 through Wm for correcting operating deviation, and outputs corrected values for correcting the detected values DS based on the weighted values W1 through Wm.

The first average calculator 132 calculates first through (M)-th readout line averages AVG1 through AVGm based on the initial values IS. The first through (M)-th readout line averages AVG1 through AVGm may be averages of the initial values IS readout from each of the first through (M)-th readout lines OUT1 through OUTm. The first average calculator 132 receives the initial values IS of the pixels P from the readout integrated circuits 120. The first average calculator 132 calculates a (K)-th readout line average AVGk that is an average of the initial values of the pixels connected to the (K)-th readout line OUTk. Similarly, the first average calculator 132 calculates the first through (M)-th readout line averages AVG1 through AVGm.

The second average calculator 134 calculates an initial value average M, that is an average of the initial values IS based on the first through (M)-th readout line averages AVG1 through AVGm.

The weighted value calculator 136 calculates first through (M)-th weighted values W1 through Wm with respect to the first through (M)-th readout lines OUT1 through OUTm. This is accomplished by dividing each of the first through (M)-th readout line averages AVG1 through AVGm by the initial value average M. In one embodiment, the first through (M)-th weighted values W1 through Wm may be applied to input image data DATA, e.g., data signals to be provided to the data driver 150. The first through (M)-th weighted values W1 through Wm may be calculated based on Equation 1:

$$Wk=AVGk/M \quad (1)$$

where Wk denotes the (K)th weighted value corresponding to the (K)th pixel column, AVGk denotes the (K)th readout line average corresponding to the (K)th pixel column, and M denotes the initial value average.

The deviation corrector 130 may further include the degradation compensator 138. The degradation compensator 138 generates corrected values of the detected values DS to compensate degradation of the pixels. The degradation compensator 138 may generate these corrected values by respectively applying the first through (M)-th weighted values W1 through Wm to the detected values DS of the pixels corresponding to the first through (M)-th readout lines OUT1 through OUTm, and generating the corrected image data DATA based on the corrected values to correct the input image data DATA. The degradation compensator 138 may receive the detected values DS detected at a predetermined time and the first through (M)-th weighted values W1 through Wm.

In one embodiment, the degradation compensator 138 may generate one of the corrected values by multiplying a detected value of a specific pixel and a weighted value of the specific pixel. The corrected values may correct (or compensate) operating deviation of the readout integrated circuits 120. Thus, accuracy of the detected values having degradation information may be improved. The degradation compensator 138 may receive the input image data DATA from the timing controller 160 or an external apparatus. The degradation compensator 138 may generate the corrected image data DATA' for correcting the input image data DATA based on the corrected values. In one embodiment, the degradation compensator may provide the corrected image data DATA' to the data driver 150.

As described above, the deviation corrector 130 in the display device 100 generates the weighted values to correct the operating deviation of the readout integrated circuits 120 based on the initial values IS, and corrects the detected values having the degradation information of the pixels based on the weighted values. Thus, the operating deviation of the readout integrated circuits 120 may be improved and accuracy of the detected values may be improved.

Figure 5:
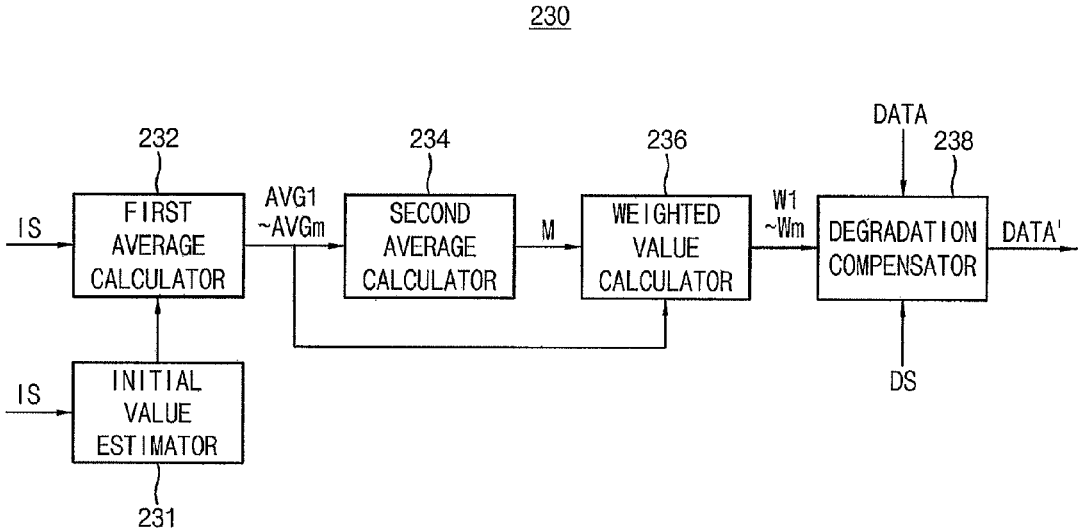
FIG. 5 illustrates another embodiment of a deviation corrector.

FIG. 5 illustrates another embodiment of a deviation corrector 230 in the display device of FIG. 1. The deviation corrector 230 is substantially the same as the deviation corrector explained with reference to FIG. 4, except for the initial value estimator.

Referring to FIGS. 1, 2, and 5, the deviation corrector 230 includes an initial value estimator 231, a first average calculator 232, a second average calculator 234, a weighted value calculator 236, and a degradation compensator 238.

The pixels are degraded as the display device 100 operates. The initial value IS may not be generated at the degraded pixel, such that the operating deviation of the readout integrated circuits 120 may not be corrected. Thus, the deviation corrector 230 may estimate an estimated initial value EIS of the degraded pixel using the initial values of non-degraded pixels adjacent to the degraded pixel.

The initial value estimator 231 calculates the estimated initial value EIS of a degraded pixel based on the initial values of non-degraded pixels adjacent to the degraded pixel, when the degraded pixel is detected. The display panel 110 may include a plurality of degraded pixels. In one embodiment, the non-degraded pixels used for calculating the estimated initial value EIS and the degraded pixel may be included in a same pixel column.

For example, the initial value estimator 231 may calculate the estimated initial value EIS of the degraded pixel in the (K)-th pixel column by interpolating the initial values of the non-graded pixels in the (K)-th pixel column. The degraded pixel may be located between the non-graded pixels. In one embodiment, the non-degraded pixels used for calculating the estimated initial value and the degraded pixel may be in a same pixel row.

For example, the initial value estimator 231 may calculate the estimated initial value EIS of the degraded pixel in the (K)-th pixel row by interpolating the initial values of the non-graded pixels in the (K)-th pixel row. The degraded pixel may be located between the non-graded pixels. In one embodiment, the initial value estimator 231 may calculate the estimated initial value EIS of the degraded pixel by bilinear interpolating the initial values of the non-graded pixels. The initial value estimator 231 may provide the estimated initial value EIS to the first average calculator 232. Since these are examples, a different method for calculating the estimated initial value may be used in another embodiment.

The first average calculator 232 calculates first through (M)-th readout line averages AVG1 through AVGm based on the initial values IS and estimated initial values EIS. The first through (M)-th readout line averages AVG1 through AVGm may be averages of the initial values IS and the estimated initial values EIS. The first average calculator 232 may calculate a (K)-th readout line average AVGk based on the initial values corresponding to a (K)-th pixel column and the and the estimated initial value corresponding to the (K)-th pixel column when the degraded pixel is in the (K)-th pixel column.

The second average calculator 234 may calculate an initial value average M, that is an average of the initial values IS and the estimated initial values EIS, based on the first through (M)-th readout line averages AVG1 through AVGm.

The weighted value calculator 236 may calculate first through (M)-th weighted values W1 through Wm with respect to the first through (M)-th readout lines OUT1 through OUTm. This may be accomplished by dividing each of the first through (M)-th readout line averages AVG1 through AVGm by the initial value average M.

The degradation compensator 238 may generate corrected values of the detected values DS to compensate degradation of the pixels. This may be accomplished by respectively applying the first through (M)-th weighted values W1 through Wm to the detected values DS of the pixels corresponding to the first through (M)-th readout lines OUT1 through OUTm, and generating the corrected image data DATA' based on the corrected values to correct the input image data DATA.

As described above, the deviation corrector 230 calculates the estimated initial values based on the initial values of non-degraded pixels adjacent to the degraded pixel, when one or more degraded pixels exist. The deviation corrector 230 may therefore generate weighted values for correcting deviation of the readout integrated circuits 120. The deviation corrector 230 may efficiently compensate degradation of the pixels based on the weighted values.

Figure 6A:
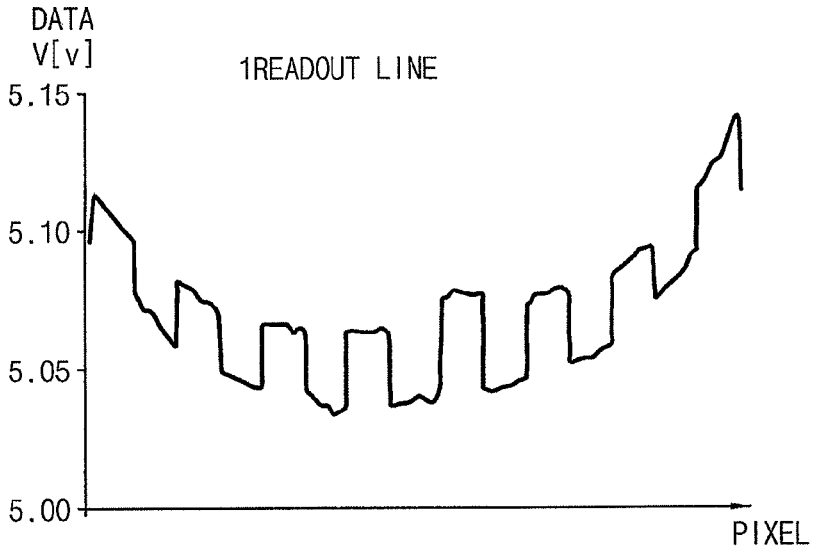
FIG. 6A illustrates an example of detected values output from a readout line when several pixels are degraded.
Figure 6B:
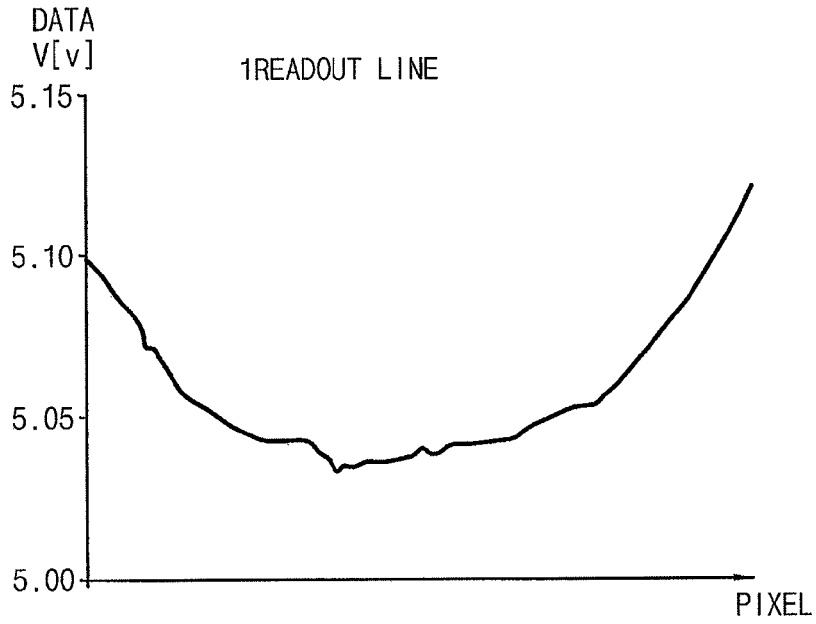
FIG. 6B illustrates an example of estimated initial values calculated based on initial values in FIG. 6A.

FIG. 6A is a graph illustrating an example of detected values output from a readout line in the display device of FIG. 1 when several pixels are degraded. FIG. 6B is a graph illustrating an example of estimated initial values calculated based on initial values of FIG. 6A. Referring to FIGS. 5 through 6B, the initial value estimator 231 in the deviation corrector 230 corrects the detected values of the degraded pixels to be the estimated initial values.

FIG. 6A illustrates the initial values output from one of the readout lines. The readout integrated circuit may readout the initial values of a pixel column (or a pixel row) including several degraded pixels. As illustrated in FIG. 6A, the detected values of the degraded pixels may be far off the detected values of the non-degraded pixels (e.g., the initial values). Thus, the detected values of the degraded pixels may be corrected in order to correct the deviation of the readout integrated circuits.

In one embodiment, the initial value estimator 231 in FIG. 6B may calculate the estimated initial value of the degraded pixels based on the initial values of non-degraded pixels adjacent to the degraded pixel. For example, the estimated initial values may be calculated by interpolation of the initial values. The deviation corrector 230 may calculate the weighted values each corresponding to the readout lines based on the estimated initial values and the initial values.

Figure 7:
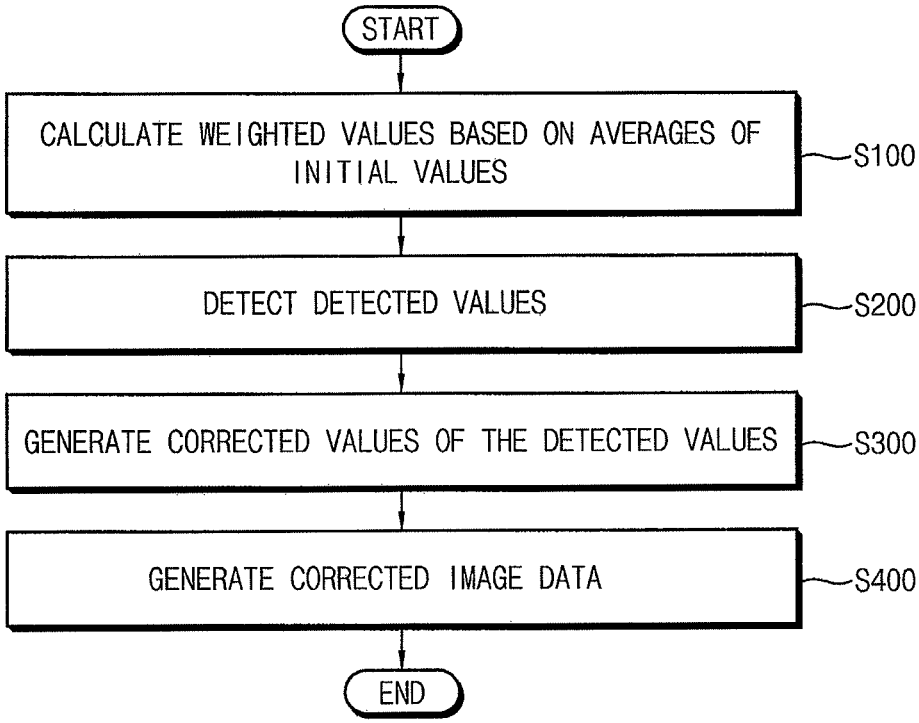
FIG. 7 illustrates an embodiment of a method for compensating degradation in a display device.

FIG. 7 illustrates an embodiment of a method for compensating degradation in a display device. Referring to FIGS. 1 and 7, this method includes calculating weighted values to correct operating deviation of a plurality of readout integrated circuits 120 based on an average of initial values S100, detecting detected values having degradation information of the pixels S200, calculating corrected values to compensate degradation of the pixels S300, and generating corrected image data to correct input image data based on the corrected values S400.

In operation S100, the weighted values may be calculated based on an average of initial values output from the readout integrated circuits when a display panel 110 is in an initial state in which the pixels are non-degraded. The weighted values may be determined according to a plurality of readout lines OUT1 through OUTm, respectively. For example, one of the weighted values may be applied to image data related to pixels connected to one of the readout lines.

In one embodiment, the display panel 110 may include first through (M)-th pixel columns, where M is a positive integer greater than 1. first through (M)-th pixel columns may be connected to first through (M)-th readout lines OUT1 through OUTm, respectively. The number of readout lines OUT1 through OUTm may be equal to the number of data lines DL1 through DLm.

In one embodiment, the readout lines OUT1 through OUTn may be arranged in the pixel row direction. For example, the number of readout lines OUT1 through OUTm may be equal to the number of the scan lines SL1 through SLm. Meanwhile, the initial values of the pixels may correspond to drive currents of the pixels in the initial state or drive voltages of the pixels in the initial state.

In one embodiment, the detected values output from the readout integrated circuits 120 may be provided to the deviation corrector 130 to calculate the weighted values. An operation of calculating the weighted values may be implemented, for example, by a software algorithm.

In operation S200, the detected values having degradation information of the pixels are detected by the readout integrated circuits. In one embodiment, a detecting cycle may be controlled by a control signal output from the timing controller 160. The detected values may correspond to drive currents of the pixels in the initial state or drive voltages of the pixels in the initial state.

In operation S300, the corrected values of the detected values are calculated by applying the weighted values to the detected values of the pixels to compensate degradation of the pixels. In one embodiment, one of the corrected values may be calculated by multiplying a detected value of a specific pixel and a weighted value of the specific pixel. The corrected values may correct (or compensate) the operating deviation of the readout integrated circuits 120. Thus, accuracy of the detected values having degradation information may be improved.

In operation S400, the corrected image data may be generated based on the corrected values to correct input image data. The display device 100 may display an image based on the corrected image data. The method for compensating degradation of the display device 100 may be as described above referred to FIGS. 1 through 5.

As described above, the method for compensating degradation of the display device, including a plurality of readout integrated circuits, may correct the detected values having degradation information of the pixels based on weighted values generated based on the initial values of the detected values. As a result, operating deviation of the readout integrated circuits 120 may be improved and accuracy of the detected values may be improved. Thus, degradation of the pixels may be efficiently compensated.

In addition, the operations of calculating weighted values and corrected values may be executed in hardware, software, or both. When executed purely in software, additional hardware circuits are not required, and thus manufacturing cost and time may be reduced.

Figure 8:
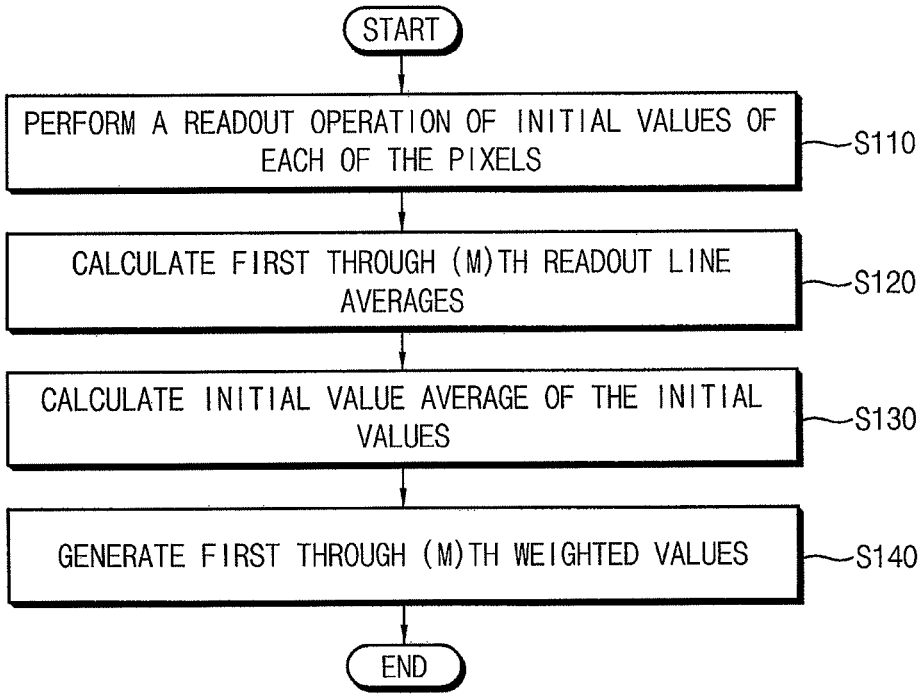
FIG. 8 illustrates an embodiment of a method for calculating a weighted value.

FIG. 8 illustrates an embodiment of a method for calculating a weighted value based on the method of FIG. 7. Referring to FIGS. 1, 4, 7, and 8, the method for calculating the weighted values for correcting the deviation of the readout integrated circuits 120 may include performing a readout operation of the initial values IS S110 that are output from the first through (M)-th readout lines OUT1 through OUTm, calculating first through (M)-th readout line averages AVG1 through AVGm S120 that are averages of the initial values IS respectively corresponding to the first through (M)-th readout lines OUT1 through OUTm, calculating an initial value average M S130, that is an average of the initial values IS, based on the first through (M)th readout line averages AVG1 through AVGm, and calculating first through (M)-th weighted values W1 through Wm corresponding to the first through (M)-th readout lines OUT1 through OUTm S140 by dividing the first through (M)-th readout line averages AVG1 through AVGm by the initial value average M. The method for calculating the weighted values referring to FIG. 8 may be used when all pixels in the display panel 110 are non-graded.

In operation S110, the initial values IS are output from the first through (M)-th readout lines OUT1 through OUTm. The readout integrated circuits 120 readout the initial values IS based on a control signal from the timing controller 160.

In operation S120, the first through (M)-th readout line averages AVG1 through AVGm are calculated. For example, the deviation corrector 130 may calculate a (K)-th readout line average based on the initial values of the pixels connected to the (K)-th readout line OUTk. Similarly, the deviation corrector 130 may calculate the first through (M)-th readout line averages AVG1 through AVGm.

In operation S130, the initial value average M are calculated based on the first through (M)-th readout line averages AVG1 through AVGm.

In operation S140, the first through (M)-th weighted values W1 through Wm may be calculated based on the first through (M)-th readout line averages AVG1 through AVGm and the initial value average M. An operation for calculating the weighted values may be executed, for example, by a software algorithm. The method for calculating the weighted values may be as described above referring to FIGS. 1 through 4.

Figure 9:
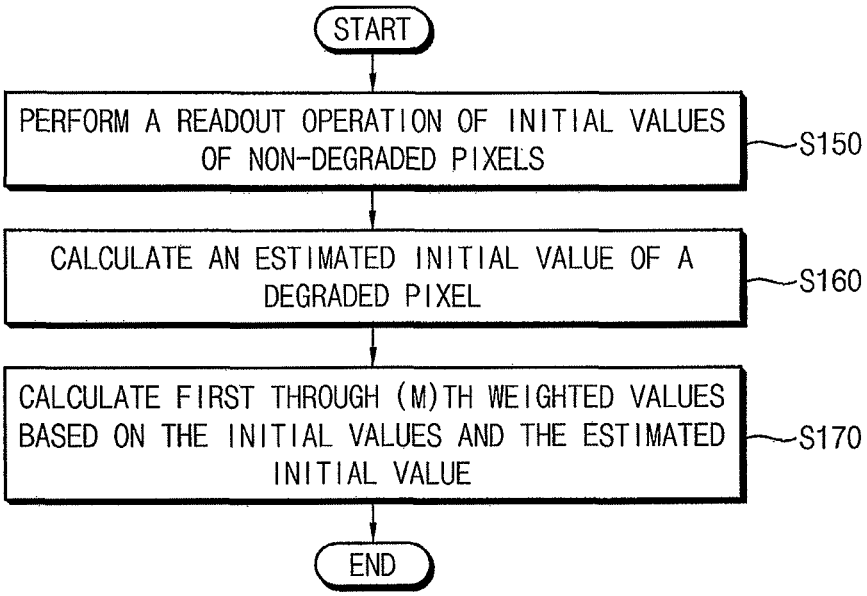
FIG. 9 illustrates another embodiment of a method for calculating a weighted value.

FIG. 9 illustrates another embodiment of a method for calculating a weighted value based on the method of FIG. 7. This method may be applied when a degraded pixel is detected during a period to readout the initial values for calculating the weighted values for correcting the deviation of the readout integrated circuits 120.

Referring to FIGS. 1, 5, 7, and 9, the method includes performing a readout operation of the initial values IS S110 output from the first through (M)-th readout lines OUT1 through OUTm, calculating an estimated initial value EIS of the degraded pixel S160, and calculating first through (M)th weighted values W1 through Wm corresponding to the first through (M)th readout lines OUT1 through OUTm based on the initial values IS and the estimated initial value EIS.

The initial value IS may not be generated at the degraded pixel, and thus the operating deviation of the readout integrated circuits 120 may not be corrected. In this case, the estimated initial value EIS of the degraded pixel may be estimated based on the initial values of non-degraded pixels that are neighboring to the degraded pixel.

The initial values IS may be output from the first through (M)-th readout lines OUT1 through OUTm (S150). The plurality of readout integrated circuits 120 may readout the initial values IS by receiving a control signal from the timing controller 160.

The estimated initial value EIS of the degraded pixel may be calculated (S160). A plurality of estimated initial values EIS corresponding to the number of degraded pixels may be calculated when a plurality of degraded pixels exist in the display panel 110. In one embodiment, the estimated initial value EIS may be estimated based on the initial values IS of non-degraded pixels adjacent to the degraded pixel. For example, the estimated initial value EIS may be estimated by interpolating at least two of the initial values IS. In one embodiment, the non-degraded pixels used for calculating the estimated initial value EIS and the degraded pixel may be in a same pixel column. In another embodiment, the non-degraded pixels used for calculating the estimated initial value and the degraded pixel may be included in a same pixel row.

The first through (M)-th weighted values W1 through Wm may be calculated based on the initial values IS and the estimated initial values EIS. In one embodiment, the first through (M)-th weighted values W1 through Wm may be calculated by the calculating method of FIG. 8.

As described above, the method for calculating the weighted values may calculate the estimated initial values based on the initial values of non-degraded pixels adjacent to the degraded pixel when the degraded pixels exist. As a result, weighted values for correcting the deviation of the readout integrated circuits 120 may be generated. A method for compensating degradation of the display device may efficiently compensate degradation of the pixels based on the weighted values. In addition, an operation for calculating the weighted values may be implemented, for example, by a software algorithm (e.g., averaging algorithm, multiplying algorithm, etc). Thus, a compensating pixel degradation program having the algorithm may be automatically run or run by control of a user, regardless of time and place.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The calculators, compensators, and other processing and control features of the embodiments described herein may be implemented in logic which, for example, may include hardware, software, or both. When implemented at least partially in hardware, the calculators, compensators, and other processing and control features may be, for example, any one of a variety of integrated circuits including but not limited to an application-specific integrated circuit, a field-programmable gate array, a combination of logic gates, a system-on-chip, a microprocessor, or another processing or control circuit.

When implemented in at least partially in software, the calculators, compensators, and other processing and control features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, a display device may include a plurality of readout integrated circuits for measuring (or detecting) degrees of degradation of pixels. The detected values output from the readout integrated circuits may be different, even though the pixels have the same degree of degradation, because the readout integrated circuits have operating deviation each other. As a result, the accuracy of detecting pixel degradation decreases when the readout integrated circuits are used for detecting pixel degradation.

In accordance with one or more of the aforementioned embodiments, a display device and method generates weighted values for correcting deviation of the readout integrated circuits. As a result, accuracy of the readout circuits may be improved, along with compensation of pixel degradation.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display device, comprising:

a display panel including a plurality of pixels;

a plurality of readout integrated circuits to perform a readout operation of detected values including degradation information of the pixels, via a plurality of readout lines connected to the pixels, when a degradation detecting operation is performed;

a deviation corrector to calculate weighted values to correct operating deviation of the readout integrated circuits based on an average of initial values, and to generate corrected image data to correct input image data based on the weighted values, the initial values being the detected values output from the readout integrated circuits when the display panel is in an initial state in which the pixels are non-degraded;

a scan driver to provide a scan signal to the display panel via a plurality of scan lines;

a data driver to provide data signals corresponding to the corrected image data to the display panel via a plurality of data lines; and a timing controller to control the readout integrated circuits, the scan driver, and the data driver.

2. The display device as claimed in claim 1, wherein:

the display panel includes first through (M)-th pixel columns, where M is a positive integer greater than 1, and the first through (M)-th pixel columns are connected to first through (M)-th readout lines, respectively.

3. The display device as claimed in claim 2, wherein the deviation corrector includes:

a first average calculator to calculate first through (M)-th readout line averages based on the initial values, the first through (M)-th readout line averages being averages of the initial values readout from each of the first through (M)-th readout lines;

a second average calculator to calculate an initial value average, that is an average of the initial values, based on the first through (M)-th readout line averages; and a weighted value calculator to calculate first through (M)-th weighted values with respect to the first through (M)-th readout lines, the first through (M)-th weighted values to be calculated dividing each of the first through (M)th readout line averages by the initial value average.

4. The display device as claimed in claim 3, wherein the deviation corrector includes:

a degradation compensator to generate corrected values of the detected values to compensate degradation of the pixels, by respectively applying the first through (M)-th weighted values to the detected values of the pixels that correspond to the first through (M)-th readout lines, and to generate the corrected image data based on the corrected values.

5. The display device as claimed in claim 4, wherein the deviation corrector includes an initial value estimator to calculate an estimated initial value of a degraded pixel based on the initial values of non-degraded pixels adjacent to the degraded pixel when the degraded pixel is detected.

6. The display device as claimed in claim 5, wherein the non-degraded pixels for calculating the estimated initial value and the degraded pixel are in a same pixel column.

7. The display device as claimed in claim 6, wherein the first calculator is to calculate a (K)-th readout line average based on the initial values corresponding to a (K)-th pixel column and the estimated initial value corresponding to the (K)-th pixel column when the degraded pixel is in the (K)th pixel column, where K is a positive integer less than or equal to M.

8. The display device as claimed in claim 5, wherein the non-degraded pixels for calculating the estimated initial value and the degraded pixel are in a same pixel row.

9. The display device as claimed in claim 1, wherein the initial values correspond to drive currents of the pixels in the initial state.

10. The display device as claimed in claim 1, wherein the initial values correspond to drive voltages of the pixels in the initial state.

11. The display device as claimed in claim 1, wherein a number of the readout lines is equal to a number of the data lines.

12. The display device as claimed in claim 1, wherein the deviation corrector is in the timing controller.

13. A method for compensating degradation of a display device, the method comprising:

calculating weighted values to correct operating deviation of a plurality of readout integrated circuits, the weighted values to be calculated based on an average of initial values output from the readout integrated circuits when a display panel is in an initial state in which the pixels are non-degraded;

detecting detected values including degradation information of the pixels by the readout integrated circuits;

calculating corrected values of the detected values to compensate degradation of the pixels by applying the weighted values to the detected values of the pixels; and generating corrected image data to correct input image data based on the corrected values.

14. The method as claimed in claim 13, wherein:

the display panel includes first through (M)-th pixel columns, where M is a positive integer greater than 1, and the first through (M)-th pixel columns are connected to first through (M)th readout lines, respectively.

15. The method as claimed in claim 14, wherein calculating the weighted values includes:

performing a readout operation of the initial values output from the first through (M)-th readout lines;

calculating first through (M)th readout line averages that correspond to respective averages of the initial values corresponding to the first through (M)-th readout lines;

calculating an initial value average corresponding to an average of the initial values, the initial value average calculated based on the first through (M)-th readout line averages; and calculating first through (M)-th weighted values corresponding to the first through (M)-th readout lines, the first through (M)-th weighted values calculated by dividing the first through (M)-th readout line averages by the initial value average.

16. The method as claimed in claim 14, wherein calculating the weighted values includes:

calculating an estimated initial value of a degraded pixel when the degraded pixel is detected; and calculating first through (M)-th weighted values corresponding to the first through (M)-th readout lines based on the initial values and the estimated initial value.

17. The method as claimed in claim 16, wherein the estimated initial value is estimated based on the initial values of non-degraded pixels adjacent to the degraded pixel.

18. The method as claimed in claim 13, wherein the initial values correspond to drive currents of the pixels in the initial state.

19. The method as claimed in claim 13, wherein the initial values correspond to drive voltages of the pixels in the initial state.

20. The method as claimed in claim 13, wherein a number of the readout lines is equal to a number of the data lines.

* * * * *